United States Patent [19]

Wyatt

[11] 4,387,508

[45] Jun. 14, 1983

[54] APPARATUS FOR MAGNETICALLY ASSEMBLING FRAGILE PARTS

[75] Inventor: Kenneth L. Wyatt, Oklahoma City, Okla.

[73] Assignee: Western Electric Company, Inc., New York, N.Y.

[21] Appl. No.: 238,315

[22] Filed: Feb. 26, 1981

[51] Int. Cl.[3] ..... H01F 41/02

[52] U.S. Cl. ..... 29/738; 29/609; 29/744; 29/810; 271/193; 271/DIG. 3; 414/35

[58] Field of Search ..... 29/609, 738, 810, 744, 29/DIG. 46; 271/18.1, 18.2, 131, 133, 134, 193, DIG. 3; 414/122, 125, 131, 36, 35

[56] References Cited

U.S. PATENT DOCUMENTS

| | | | |
|---|---|---|---|
| 2,750,659 | 6/1956 | Sassi | 29/738 |
| 2,999,687 | 9/1961 | Hommel | 271/18.1 |
| 3,136,043 | 6/1964 | Ruellan | 29/738 |
| 3,353,822 | 11/1967 | Dangelmaier et al. | 271/18.1 |

OTHER PUBLICATIONS

Ciszak, G. R. and Offer, Jr., P. J., Apparatus for Inserting & Interleaving Laminations Within Magnetic Coil Bobbins, Tech. Digest #30, Western Electric Co., Inc., N.Y., N.Y., Apr. '73, pp. 3 and 4.

Colwell, D. R., Metzer, D. J., Phillips, P. L., Apparatus for Assembling E-Shaped Laminations in a Transformer Coil, Tech. Digest #29, Western Electric Co., Inc., N.Y., N.Y., Jan. '73, pp. 15 and 16.

*Primary Examiner*—Carl E. Hall
*Assistant Examiner*—P. W. Echols
*Attorney, Agent, or Firm*—R. P. Miller

[57] ABSTRACT

Two spaced stacks of magnetically soft E-cores, (17 and 18) are supported in spaced relation by pairs of magnets (38 and 39) on opposite sides of each stack. A pair of shuttles (41 and 47) move alternately toward and away from each other and under the stacks to pick off the lower core in each stack. The shuttles alternately advance the cores into a transformer frame (10) where a pair of magnets (66 and 67) are effective to hold the cores in an assembled position within the frame while the shuttles return for another E-core feeding operation. Entry of the cores into the frame is facilitated by a pair of rotating drums (71 and 72) having staggered arrays of magnets (78 and 79) which act to rapidly vibrate the E-cores (17 and 18) and thus prevent lodging of the cores against the frame.

5 Claims, 8 Drawing Figures

FIG. 6
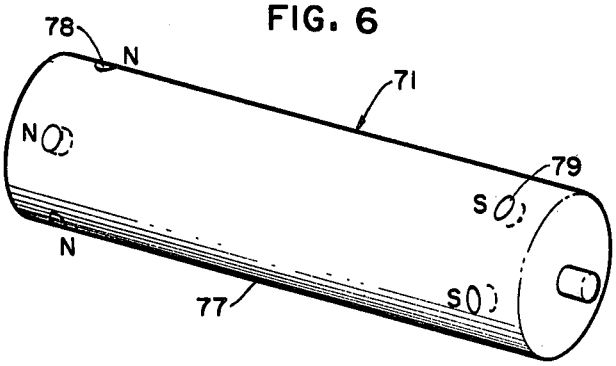
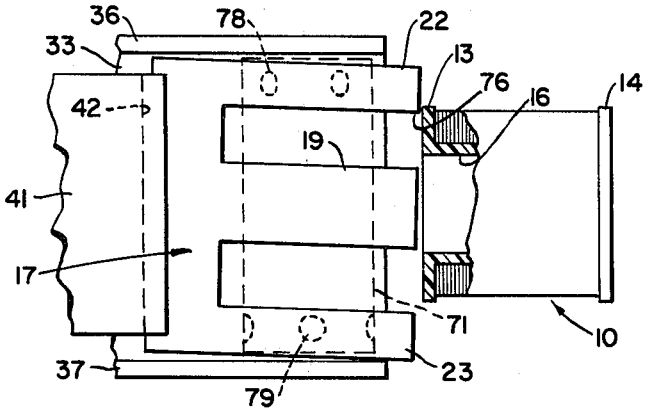
FIG. 7
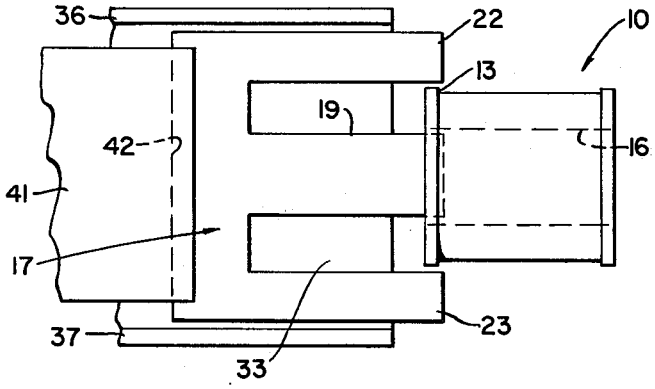
FIG. 8

APPARATUS FOR MAGNETICALLY ASSEMBLING FRAGILE PARTS

FIELD OF THE INVENTION

This invention relates to methods and apparatus for magnetically assembling fragile parts and, more particularly, to the utilization of magnetic facilities and forces for stacking parts in one or more piles, feeding the parts from the stacks to a common assembly area whereat magnetic forces are utilized to seat the parts within a constricting opening formed in a frame.

BACKGROUND OF THE INVENTION

Many diverse assembly operations require the placement of fragile components or elements into openings formed in rigid structures. Extreme care must be exercised in such assembly operations lest the elements will hit the rigid edges of the openings and will be bent or otherwise damaged. As an example, in the manufacture of transformers, induction coils and the like, thin laminates of magnetically soft material are inserted in openings formed in rigid bobbins that have been previously wound with coils of wire. The laminates are not only magnetically soft but are also physically soft in that the laminates are easily bent upon hitting the edges of the bobbin openings. Even though machines have been designed to automatically insert the laminates in the bobbin openings, their use is rather limited when the laminates are thin and readily susceptible to bending upon the laminates hitting the edges of the bobbin opening. In such situations a jamming easily occurs and the automatic cycling must be interrupted to permit an attending operator to remove the bent laminate. These interruptions occur frequently and, hence, often make the use of such machines economically prohibitive. As a result, resort is made to manual assembly of the laminations. The problem is further compounded where the laminations are in an E-shaped configuration requiring the insertion of the central laminate leg in the bobbin opening while the outer laminate legs are assembled to span the bobbin.

A machine for assembling I and E shaped cores into an opening formed by a transformer winding is shown in U.S. Pat. No. 2,750,659 issued June 19, 1956 to U. Sassi. In this machine, a pair of spaced magnets are oscillated to alternately pick up laminations from the tops of spaced stacks and deposit the laminates adjacent to the opening in the transformer winding. A pair of pusher devices are alternately operated to push the deposited laminations into the transformer winding opening. When the laminates are delivered to the position adjacent the transformer winding opening they are held in position by a pair of magnets that are stronger than the laminate delivery magnets.

Another apparatus for assembling and interleaving laminations within a coil bobbin is disclosed on Pages 3 and 4 of an article appearing in the April, 1973 issue of the Technical Digest No. 30 published by the Western Electric Company, Inc., New York, N.Y. In this instance, a shuttle provided with magnets is reciprocated between the tops of two stacks of E-shaped laminations to alternately pick off the top laminations which are then alternately inserted from opposite sides into an opening formed in the coil bobbin. As the shuttle moves from one stack to the other, the laminations are inserted in the coil bobbin opening and are thus stripped from the magnet carried by the reciprocating shuttle.

In another class of insertion machines, a pair of reciprocating pushers sequentially move laminations from the bottom of a pair of spaced stacks. These lowermost laminations are advanced into a coil bobbin opening interposed between the stacks. Examples of these machines are shown in U.S. Pat. No. 3,136,043 issued June 9, 1964 to R. L. J. Ruellan, and in an article appearing on pages 15 and 16 of the Technical Digest No. 29 published January, 1973, by the Western Electric Company.

SUMMARY OF THE INVENTION

The invention contemplates, among other things, magnetically supporting two displaced stacks of thin, magnetically soft members, alternating advancing the lowermost members from the stacks into a frame positioned between the stacks, and magnetically vibrating the members during seating within the frame whereafter each seated member is magnetically held.

More particularly, two stacks of E-shaped transformer core members are magnetically supported with the individual core members being spaced from each other due to the magnetization induced into the core members. A pair of feed slides or shuttles are alternately operated to pick off the lowermost core members and successively advancing each core member into a transformer frame positioned between the stacks so that the center leg of the core member is inserted in an opening in the frame while the other two outer legs span the frame. A pair of magnetic rotary devices are provided to magnetically induce forces to vibrate each core member during seating in the frame whereafter the core is held by another magnetic device.

Among the features of the invention is the construction of the magnetic rotary device which consists of a roll having embedded in the peripheral surface thereof two series of permanent magnets. The magnets are located at opposite ends of the rolls and are circumferentially spaced about the periphery in such a fashion that one series of magnetics is circumferentially offset with respect to the other. As each E-core is seated, the magnetic roll is rotated to alternately magnetically attract a first outer core leg and then the other outer core leg to effectuate a planar vibration of the core member. This vibratory action insures that the rotary center leg of the core member passes without impediment into the opening formed in the core frame.

BRIEF DESCRIPTION OF THE DRAWINGS

Other features and advantages of the present invention will be apparent upon consideration of the detailed description in conjunction with the drawings, wherein:

FIG. 6 is a perspective view of one magnetic roller for vibrating the E-cores;

FIG. 7 is a top view of the assembly area showing an E-core being restrained during assembly into the core; and FIG. 8 is a view similar to FIG. 7 illustrating the passage of a vibrated core into the frame.

DETAILED DESCRIPTION

Figures 1, 2:
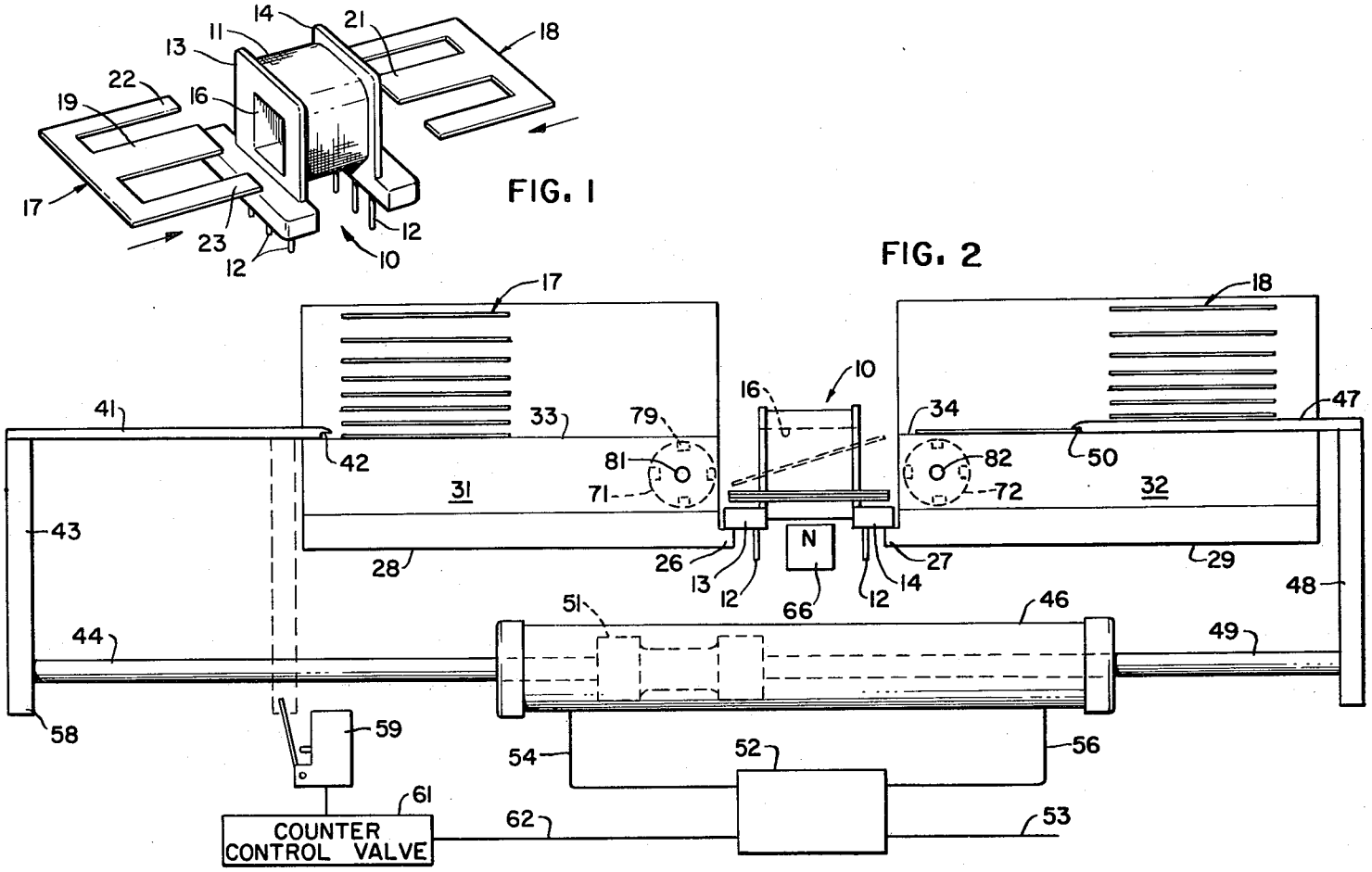
FIG. 1 is a perspective view of a pair of transformer E-cores and a coil frame into which the cores are to be assembled by the method and apparatus of the present invention.
FIG. 2 is a front elevational view of a machine utilizing magnetic forces to assemble E-cores in a transformer frame in accordance with the principles of the invention.

Referring to FIG. 1, there is shown a transformer coil bobbin 10 having primary and secondary windings 11 connected to terminals 12. The bobbin includes a pair of flanges 13 and 14 and a square-shaped hole 16 extending therethrough. The present invention is concerned with assembling E-shaped laminates 17 and 18 so that center legs 19 and 21 are seated in the hole 16, and outer legs, such as legs 22 and 23, span the flanges 13 and 14. Laminates 17 and 18 are constructed of magnetically soft material; that is, when a laminate is placed in a flux setup by a magnet, the laminate is temporarily converted to a magnet but the magnetization is not retained when the material is removed from the field of the magnetic flux.

Not only are the laminates magnetically soft, but are also physically soft in that they may be bent very easily upon striking an obstruction such as would be encountered in an automatic machine insertion operation. In essence, it will be appreciated that great care must be exercised in assembling the laminates to prevent their striking the edges about the hole 16 or the flanges 13 or 14.

Referring to FIG. 2 a bobbin or coil form 10 is mounted in the machine by placing the lower portion of the flanges 13 and 14 on lips 26 and 27 projecting from frame support plates 28 and 29. The plates 28 and 29 are secured to platforms 31 and 32 having upper surfaces 33 and 34 aligned with the upper portion of the opening 16. The upper surfaces 33 and 34 are utilized as guide surfaces for the laminates 17 and 18 being advanced into the opening 16. The bobbin 10 is mounted on the supports so that the inside surface of the opening 16 is slightly above the surfaces 33 and 34 to permit the entry of the laminates from the surfaces into the opening 16.

Figure 3:
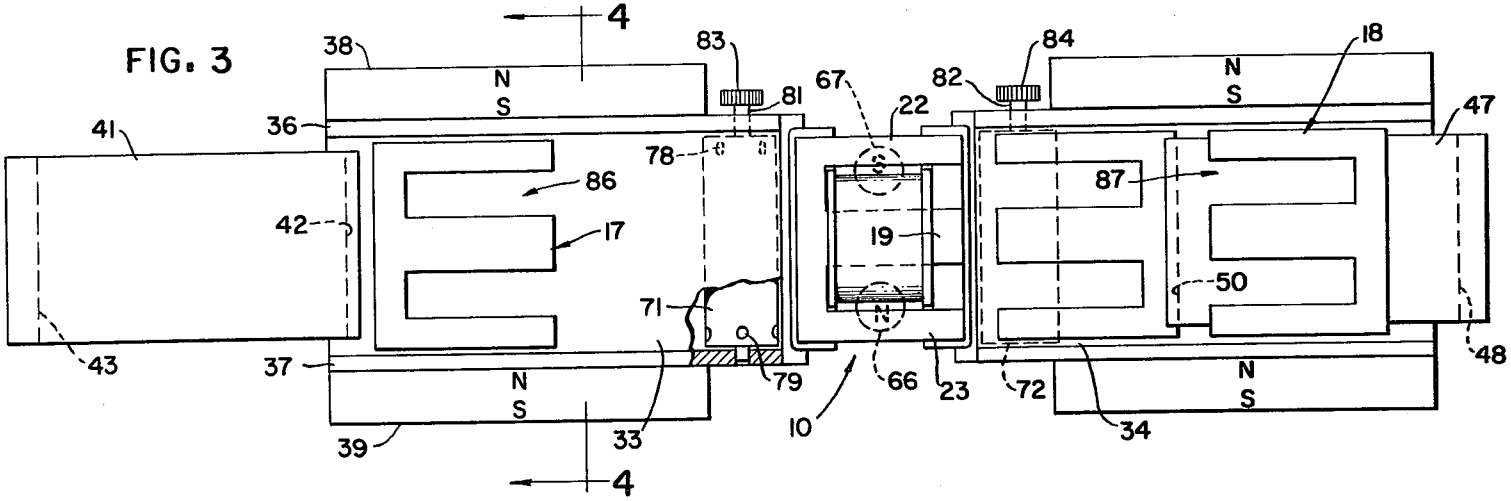
FIG. 3 is a top view of the machine shown in FIG. 2 and partially cut away to illustrate the construction of the feeding and magnetic vibrating facilities for seating the E-cores in the transformer frame.

The laminates 17 are placed in a bin comprising side walls 36 and 37 (see FIGS. 3 and 4) constructed of a material that will not substantially alter or interfere with the magnetic lines of flux established by a magnet. The materials that may be used for the construction of the bin walls include brass, aluminum, stainless steel or plastic. Positioned adjacent to the outer surfaces of the bin walls 36 and 37 are a pair of permanent plate magnets 38 and 39. The plate magnets are constructed and arranged so that the inner surface of magnet 38 is of a south magnetic pole, while the inner surface of the plate magnet 39 is a north magnetic pole. As illustrated, in FIGS. 3 and 4, the positioning of the magnetic plates 38 and 39 result in a magnetic field being established across the bin. The field has its greatest intensity in the vicinity of the inner surface of the walls 36 and 37 so that the adjacent edge sections of the laminates 17 are magnetized.

Figure 4:
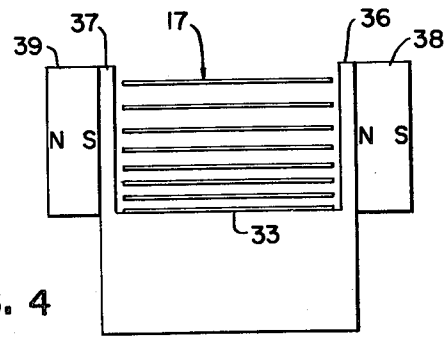
FIG. 4 is a sectional view taken along lines 4—4 of FIG. 3 to show the details of construction of a magnetic bin for magnetically supporting a stack of E-cores in spaced relationship.

The left-hand edges of the laminates 17 as viewed in FIG. 4 will be magnetized to provide south magnetic poles while the right-hand edge sections of the laminates are magnetized to provide north magnetic poles. The establishment of south magnetic poles along each of the left-hand edge sections of the laminates 17 results in magnetic repelling forces acting on adjacent laminates. In a like manner, the right-hand edges of the laminates 17 are magnetized with repelling north magnetic poles. The cumulative effect of the magnetic repelling action is that the laminates 17 are spaced apart and all of the laminates are under the influence of gravity and, hence, there is a cumulative gravitational effect resulting in a greater downward force being placed on the lowermost laminate. The gravitational or weight effect urging the laminates downward gradually diminishes from the bottom to the top of the stack so that the spacing between the lower laminates is smaller than the spacing between the top laminates. As a laminate 17 is withdrawn from the bottom of the stack, the remaining laminates will move down to force the lowermost laminate against the guide surface 33.

As shown in FIG. 2, there is positioned to the left of the lowermost laminate 17, a pusher or shuttle 41 having a laminate receiving notch 42. The pusher is connected through a bar 43 to a piston rod 44 extending from a fluid cylinder 46. A second pusher 47 is mounted to slide on the surface 34 and is connected through a bar 48 to a piston rod 49. The second pusher 47 is also provided with a laminate receiving notch 50. The piston rods 44 and 49 are connected to a common piston 51. A control valve 52 is alternately operated to apply pressurized fluid from a conduit 53 to conduits 54 to 56 to drive the piston 51 toward the left or right.

The control valve 52 is cyclically operated through a predetermined number of cycles to shift the piston 51 toward the left and then the right to cyclically move the pushers 41 and 47 to pick off succeeding lowermost laminates 17 or 18 from the respective stacks of laminates. Each time the pusher 41 is operated, an actuator rod 58 is moved to operate a switch 59 that pulses a counter 61. Upon registering a predetermined number of counts indicative of the loading of a predetermined number of laminates 17 and 18, a signal is transmitted over line 62 to interrupt the further cyclic operation of the control valve 52. The control valve may be driven by a simple motor-magnetic clutch arrangement in which the appearance of the signal on line 62 would interrupt the energization of the magnetic clutch for the motor.

The laminates 17 and 18 are moved by the pushers 41 and 47 over the surfaces 33 and 34 so that the center legs of the laminates enter the opening 16. The laminates are pushed over the edges of the surfaces 33 and 34 and drop in interleaved fashion onto the lower surface defining the opening 16 in the bobbin. A pair of magnets 66 and 67 (see FIGS. 2 and 3) are provided to assist the seating of the laminates in the opening 16 and serve to hold each laminate in position during the assembly of subsequent laminates. The magnets 66 and 67 are arranged to be positioned beneath the outer legs of the E-shaped laminate which span the periphery of the bobbin flanges 13 and 14.

In order to assist the seating of the laminates within the bobbin opening, a pair of magnetic vibrators 71 and 72 are provided. As best illustrated in FIG. 7, the advance of a laminate, such as laminate 17, may be along a path such that a corner 76 strikes the flange 13. In this situation a further pushing action on the part of the pusher 41 results in a crushing or bending of the outer leg of the laminate thus precluding the assembly of this laminate onto the coil frame. The laminate 17 must advance as shown in FIG. 8 so that neither the outer legs nor the inner leg strike an obstruction causing the laminate to hang up and subsequently crumble.

The details of construction of the magnetic vibrator 71 are shown in FIG. 6. The vibrator includes a roller 77 constructed of non-magnetizable material, such as brass or aluminum. A plurality of circumferentially spaced holes are formed near the left rim of the roller 77 to receive small cylindrical magnets 78 and to provide north magnetic poles at the surface of the roller. In a like manner, a plurality of circumferentially spaced holes are formed in the right-hand section of the roller to receive a group of magnets 79 having south magnetic poles in the surface of the roller. The circumferential arrays of holes are formed so that the magnets 78 are offset circumferentially with respect to the magnets 79. The roller vibrators 71 and 72 are mounted on axles 81 and 82 which are rotated rapidly by a drive mechanism, not shown but including the gears 83 and 84.

As a laminate, such as laminate 17, approaches the opening 16 in the coil frame, the rotating magnets 78 and 79 induce magnetism into the outer legs 22 and 23. Inasmuch as the magnetic fields are not circumferentially aligned, there is a slight twisting or vibration of the laminate. This vibration is in the plane of the laminate so that the laminate's forward edges are moved back and forth a slight degree with respect to the flange 13. This action allows the advancing edges of the laminate to seek out the opening 16 and the outer limits of the flange 13, whereupon the laminate advances to move the center leg 19 into the opening 16 while the outer legs 22 and 23 span the flange 13.

Figure 5:
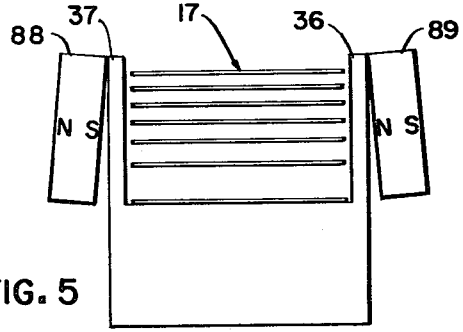
FIG. 5 is a side elevational view of an alternative construction of the magnetic bin to alter the spacing of the cores in the bin.

The walls 36 and 37 together with the magnets 38 and 39 define a bin generally designated by the reference numeral 86. A similar bin 87 is provided on the right-hand side of the machine to receive a stack of laminates 18. As an alternative, the bins 86 and 87 may be constructed in accordance with the showing in FIG. 5. In this instance, a pair of frame plate magnets 88 and 89 are mounted in canted relation with respect to the bin walls 36 and 37. The upper portion of the magnets 88 and 89 are closer to the laminates 17 and, thus, tend to pull the entire stack of magnets in an upward direction. Inasmuch as the lower portions of these magnets are spaced a greater distance from the bin walls 36 and 37, the magnetic effect is lessened and the gravitational effect more pronounced so that laminates at the bottom of the stack are spaced farther apart than the laminates at the top of the stack.

Briefly, in summary, stacks of laminates 17 and 18 are placed in the bins 86 and 87 whereupon the magnets, such as magnets 38 and 39, act on the laminates to space them apart. The clutch driven motor is operated to control the valve 52 to alternately apply pressurized fluid over the lines 54 and 56 to reciprocate the piston rods 44 and 49. The reciprocation of the piston rods causes the pushers 41 and 47 to reciprocate back and forth across the surfaces 33 and 34 to cyclically pick up the laminates 17 and 18 from the bottoms of the respective stacks. The laminates 17 and 18 are alternately inserted and interleaved within the coil frame 10. The magnetic vibrators 71 and 72 act on the advancing laminates to vibrate them in a planar fashion to insure their seating within the bobbin. The number of laminates seated is counted by the successive operation of the switch 59. When a predetermined number of switch closures are accomplished, the counter 61 is operated to interrupt the laminate assembly operation. In certain instances, it may be nearly impossible to insert the last one or two laminates without engaging the upper surface of the flanges 14 and 16. In these instances, the coil form with a predetermined number of automatically assembled laminates is removed from the apparatus and the last few laminates are manually assembled.

What is claimed is:

1. A machine for assembling magnetically soft laminates into an opening formed in a frame, which comprises:

a bin having a pair of walls for receiving a stack of magnetically soft laminates;

planar magnetic means positioned adjacent to the outer sides of said walls for establishing a magnetic field extending into said bin to magnetize the edge sections of said laminates, said magnetic means having facing surfaces magnetized with opposite polarities to induce magnetizing forces in adjacent edge sections of like polarity that act as repelling forces to separate said laminates;

means for supporting a frame with a top portion of the opening therein extending toward the lowermost laminate in said bin;

a pickup device for cyclically engaging and advancing the lowermost laminate from said bin into the top portion of the opening in the supported frame whereafter the laminate drops and seats in the frame opening;

magnets positioned adjacent to the lower portion of the supported frame for assisting the seating of the laminate in the opening and for holding the laminate in the position during the seating of subsequent laminates; and magnetic means for vibrating each advanced laminate relative to the opening to impart a slight twist to the leading edges of the laminate whereupon the leading edge seeks out the opening and then advances into the opening in the frame.

2. A machine as defined in claim 1, wherein said planar magnetic means are canted with respect to said bin wall so that the lower portions of the magnetic means are spaced further from the bin walls than the top portions to induce magnetic forces that hold the laminates in progressively greater spaced apart relation from the top of the stack to the bottom of the stack.

3. An apparatus for assembling soft magnetic laminates in a coil frame, which comprises:

a first pair of spaced vertical planar magnets having facing surfaces with opposed magnetic poles established therein for magnetically supporting in spaced relations a first stack of laminates;

a second pair of spaced vertical planar magnets having facing surfaces with opposed magnetic poles established therein for magnetically supporting in spaced relations a second stack of laminates;

means for supporting a coil frame between said first and second magnetically supported stacks of laminates;

a first shuttle mounted to move between said first pair of planar magnets for picking off the lowermost laminate from said first stack and advancing the picked off laminate into the coil frame;

a second shuttle mounted to move between said second pair of planar magnets for picking off the lowermost laminate from said second stack and advancing the picked off laminate into the coil frame;

a pair of rollers positioned adjacent to and on opposite sides of a coil frame on said supporting means, each of said rollers having two circumferential rows of spaced magnets which are offset circumferentially with respect to each other to impart slight twisting vibrations to each laminate being advanced into the coil frame to assist the leading edge of laminate to seek out the opening in the coil frame.

4. An apparatus as defined in claim 3, which includes:

a piston;

a pair of piston rods extending in opposite directions from said piston;

means coupling the ends of the piston rods to said first and second shuttle; and means for reciprocating said piston to alternately advance said first and second shuttles.

5. A machine for assembling magnetically soft laminates into an opening formed in a frame, which comprises:

a bin having a pair of walls for receiving a stack of magnetically soft laminates;

planar magnetic means positioned adjacent to the outer sides of said walls for establishing a magnetic field extending into said bin to magnetize the edge sections of said laminates, said magnetic means having facing surfaces magnetized with opposite polarities to induce magnetizing forces in adjacent edge sections of like polarity that act as repelling forces to separate said laminates means for supporting a frame with the opening therein extending toward the lowermost laminate in said bin;

a pickup device for cyclically engaging and advancing the lowermost laminate from said bin into the opening in the supported frame;

a roller; two circumferentially offset rings of magnets mounted near the opposite ends of said roller; and means for rotating said roller to induce magnetic forces in each advanced laminate to vibrate the laminate in the plane of the laminate to seek out the opening in the frame.

* * * * *

UNITED STATES PATENT AND TRADEMARK OFFICE

CERTIFICATE OF CORRECTION

PATENT NO. : 4,387,508

DATED : June 14, 1983

INVENTOR(S) : KENNETH L. WYATT

It is certified that error appears in the above—identified patent and that said Letters Patent is hereby corrected as shown below:

Column 6, after line 64, insert --magnetic means associated with said coil frame support means for holding each advanced first and second laminates within the coil frame; and--

In the drawing FIG. 4; polarity designations N (two occurrences thereof) should be S; same Figure polarity designations S (two occurrences thereof) should be N.

Signed and Sealed this

*Twenty-second* Day of *November 1983*

[SEAL]

*Attest:*

GERALD J. MOSSINGHOFF

*Attesting Officer*

*Commissioner of Patents and Trademarks*